US005639262A

United States Patent [19]

Lim

[11] Patent Number: 5,639,262

[45] Date of Patent: Jun. 17, 1997

[54] SHIELDED ELECTRICAL CONNECTOR COMPONENT ASSEMBLY

[75] Inventor: Gunsang Lim, Cordova, Tenn.

[73] Assignee: Thomas & Betts Corporation, Memphis, Tenn.

[21] Appl. No.: 410,995

[22] Filed: Mar. 27, 1995

[51] Int. Cl.[6] ..... H01R 13/648

[52] U.S. Cl. ..... 439/607; 439/638; 439/906

[58] Field of Search ..... 439/607, 608, 439/638, 609, 610, 931, 620, 76.1

[56] References Cited

U.S. PATENT DOCUMENTS

| | | | |
|---|---|---|---|
| 3,632,943 | 1/1972 | Engler et al. | 219/10.79 |
| 4,670,306 | 6/1987 | Salem | 427/258 |
| 4,831,210 | 5/1989 | Larson et al. | 174/35 |
| 4,851,609 | 7/1989 | Reddy | 174/35 |
| 4,874,336 | 10/1989 | Marsh | 439/607 |
| 5,035,649 | 7/1991 | Collier et al. | 439/607 |
| 5,075,039 | 12/1991 | Goldberg | 252/518 |
| 5,079,387 | 1/1992 | Weaver et al. | 174/17 |
| 5,120,578 | 6/1992 | Chen et al. | 427/304 |
| 5,170,009 | 12/1992 | Kadokura | 174/35 |
| 5,288,313 | 2/1994 | Portner | 106/1.11 |

*Primary Examiner*—Neil Abrams
*Assistant Examiner*—Barry Matthew L. Standig
*Attorney, Agent, or Firm*—Michael L. Hoelter; Salvatore J. Abbruzzese

[57] ABSTRACT

A shielded housing provides electrical shielding for connection components supported therein. The shielded housing may form a balun for providing impedance matching between a twisted pair cable and a coaxial or twinaxial cable. A shielded balun housing supports balun components including a pair of shielded connector components and an electrical circuit interconnecting the components. The housing includes upper and lower housing members which are secured together in a manner which establishes conductive engagement therebetween. The housing provides electromagnetic shielding between the balun and adjacent components.

17 Claims, 6 Drawing Sheets

SHIELDED ELECTRICAL CONNECTOR COMPONENT ASSEMBLY

FIELD OF THE INVENTION

The present invention relates generally to an electrically shielded housing assembly for accommodating connection components. More particularly, the present invention relates to a multi-compartment housing assembly which supports therebetween shielded electrical components where the multi-compartment housing assembly fully shields the electrical components supported therein from electromagnetic interferences.

BACKGROUND OF THE INVENTION

In the electronic industry it is widely known that certain electrical or electronic components are susceptible to adverse interferences from adjacent components. Many components generate interference in the form of electromagnetic radiation. This electromagnetic interference (EMI) can adversely affect the operation of certain other components which are positioned in close proximity thereto.

The problem is particularly acute with certain components referred to as baluns. A balun is a device which serves as a transformer for connecting balanced twisted pair cables to unbalanced coaxial or twinaxial cables by matching the electrical impedance characteristics of the two types of cables. Baluns effectively provide an electrical conversion between coaxial/twinaxial cable and twisted pair cable. Electromagnetic "noise" as a result of electromagnetic radiation from electrical components may adversely affect adjacent transmission line components such as the coaxial/twinaxial cable, the twisted pair cable and the balun. Also, the balun itself generates EMI which could adversely affect the operation of components adjacent thereto. In order to reduce the adverse effects of EMI, balun components must be effectively shielded.

It is known to employ within a balun, shielded components, such as electrical connectors or cables so as to shield the individual cable terminations. Such shielded components may include a shielded RJ45 connector, shielded multiconductor cables or shielded coaxial connectors. The baluns additionally provide for shield continuity between the shields of the individual components. Such shield continuity is typically provided by an electrical circuit assembly supported between the two components, such circuit assembly providing both the impedance matching between the two cables as well as a shield continuity.

However, in the present day electronic environment where an increasing number of electronic components are used in close proximity and where the electrical frequency of such components are increasing, the discrete shielding provided by the components in many baluns of the prior art has been found to be inadequate. This shielding insufficiency is especially prevalent in the area between the individual shielded components housed within the balun structure. At this location, shielding is either nonexistent or ineffective.

It is therefore desirable to provide a fully shielded housing assembly for supporting components of a balun. The shielded housing assembly would provide complete shielding for the components of the balun.

SUMMARY OF THE INVENTION

It is an object of the present invention to provide a shielded housing assembly for supporting electrical components.

It is a further object of the present invention to provide a fully shielded balun for providing impedance matching between a coaxial/twinaxial cable and a twisted pair cable.

In the efficient attainment of these and other objects, the present invention provides a shielded electrical connection assembly. The connection assembly includes a shielded housing having first and second housing members each being fully covered with a conductive plating. A pair of electrical connection components are supported within the housing. Each connection component includes conductive shielding thereover. The conductive shielding of the components is in electrical engagement with the conductive plating of the housing. An electrical circuit assembly is supported within the housing. The circuit assembly interconnects the conductive shielding of each of the connection components. The first and second housing members are secured together in a manner which establishes conductive continuity between the housing members.

As more particularly described by way of the preferred embodiment herein, the present invention provides a shielded balun for supporting balun components including a pair of spaced apart shielded connection components and an electrical circuit interconnecting the components. The shielded housing members support the connection components with the shields of the connection components being in electrical engagement with the shielded housing members. The housing members may be secured together in a manner which establishes conductive engagement therebetween. Such securement techniques may include conventional ultrasonic welding of the plated housing members together or securing the plated housing members together with a conductive adhesive. The shielded connection components may include a pair of shielded electrical connectors or may include the termination of a shielded cable.

DETAILED DESCRIPTION OF THE PREFERRED EMBODIMENTS

The present invention provides a fully shielded balun assembly which provides for interconnection between a coaxial or twinaxial cable and a twisted pair cable commonly referred to as shielded twisted pair cable (STP cable). Baluns are commonly used to match electrical characteristics such as the electrical impedance of the balanced STP cable to the unbalanced coaxial/twinaxial cable. It is desirable that the balun function in a shielded environment. The electrical characteristic matching should be conducted in absence of interference from electromagnetic radiation (EMI) generated by adjacent components. Further shielding the balun reduces the adverse effects of balun generated EMI on adjacent components.

Figure 1:
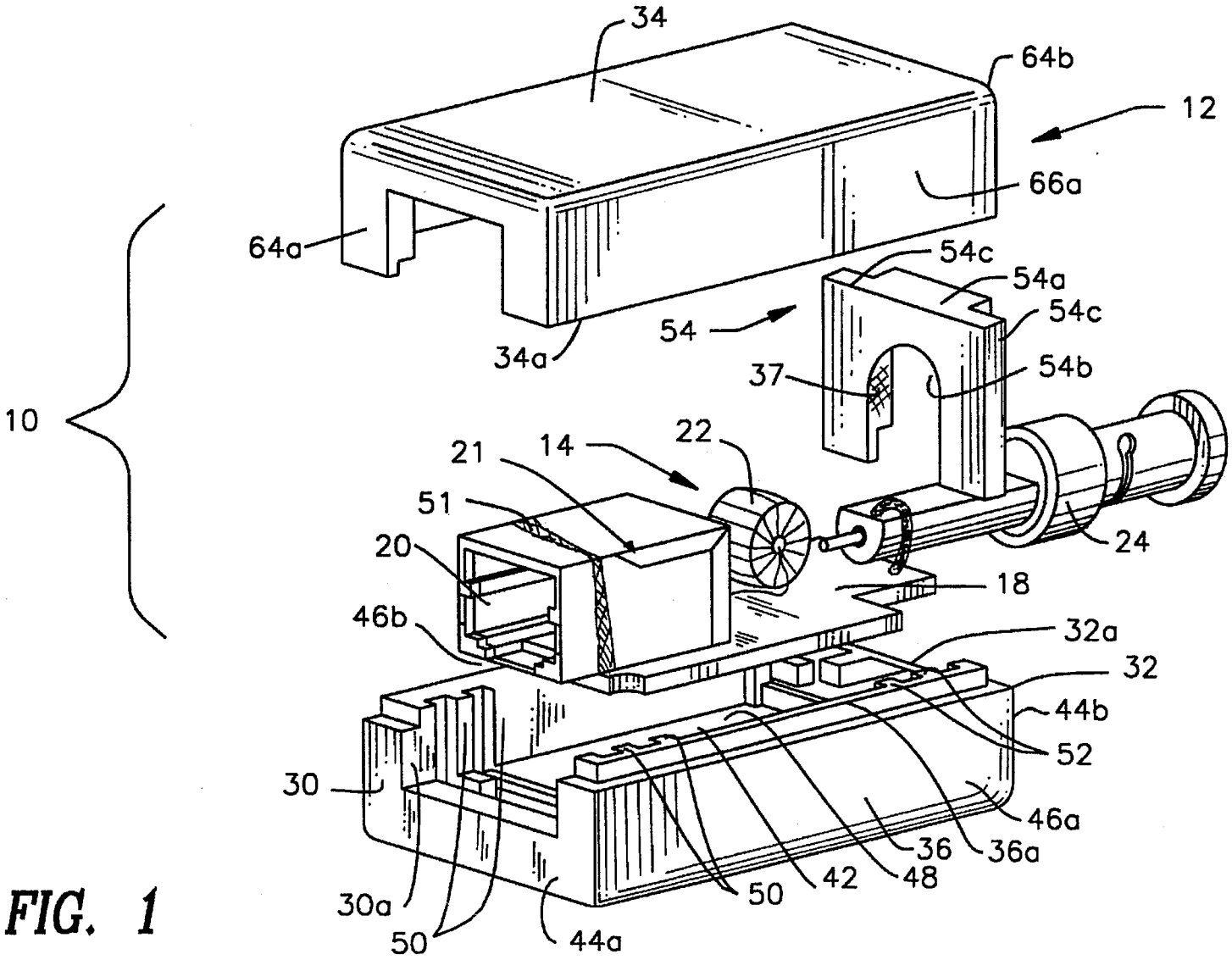
FIG. 1 is an exploded perspective view of one embodiment of the balun assembly of the present invention showing electrical components supported between upper and lower housing members.
Figure 2:
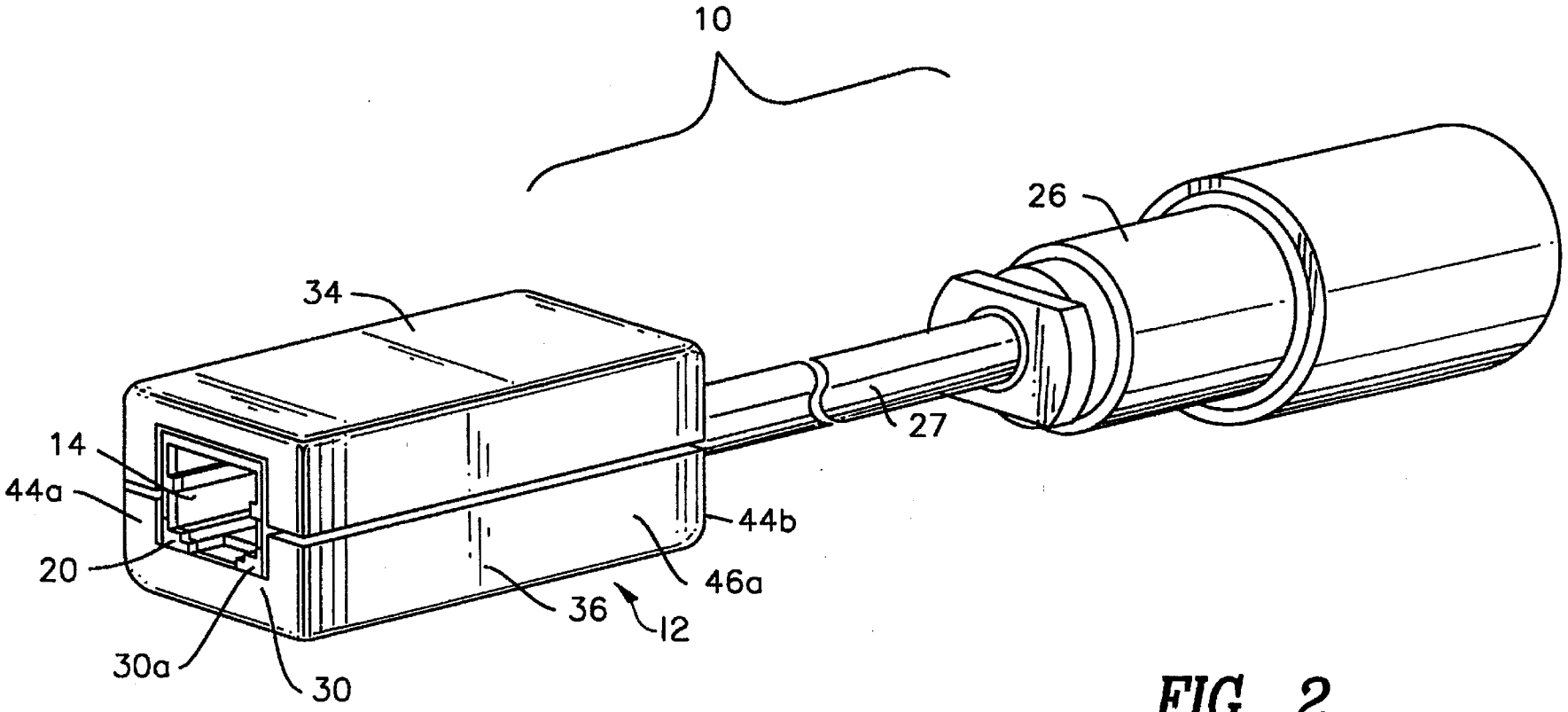
FIG. 2 is a perspective showing of a further embodiment of the shielded balun assembly of the present invention in assembled condition.

The present invention is directed to a balun assembly which provides full shielding about the components supported therein. As shown in FIGS. 1 and 2, balun assembly 10 includes a housing 12 supporting therein balun components 14. Balun components 14 may include conventional electrical components which permit the termination of STP cable as well as coaxial/twinaxial cable and to effect electrical impedance matching therebetween.

Figure 5:
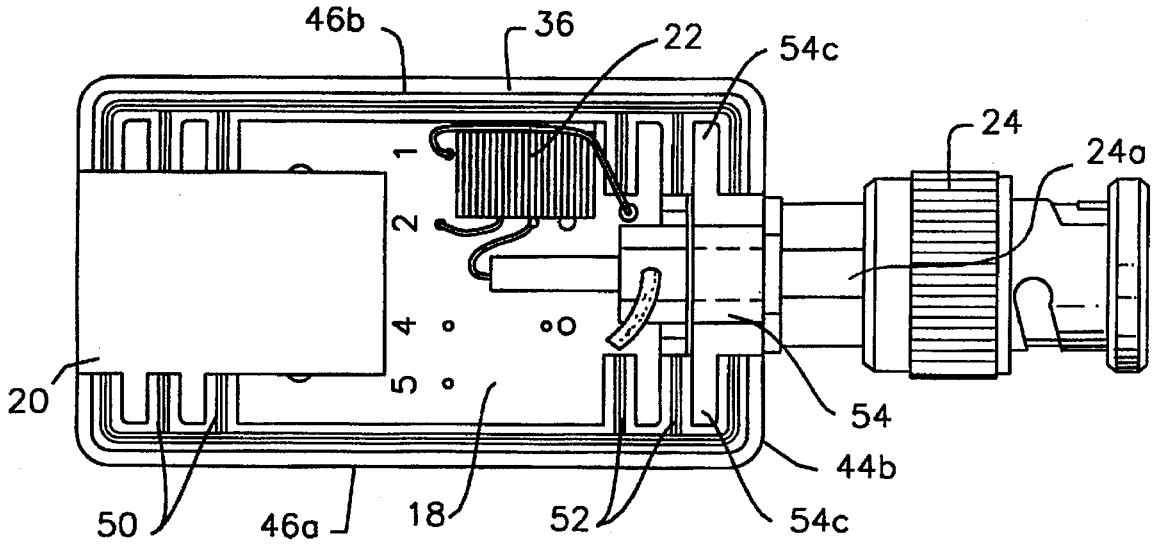
FIG. 5 is a top plan view of the lower housing portion of the balun of FIG. 1 supporting the electrical components therein.
Figure 6:
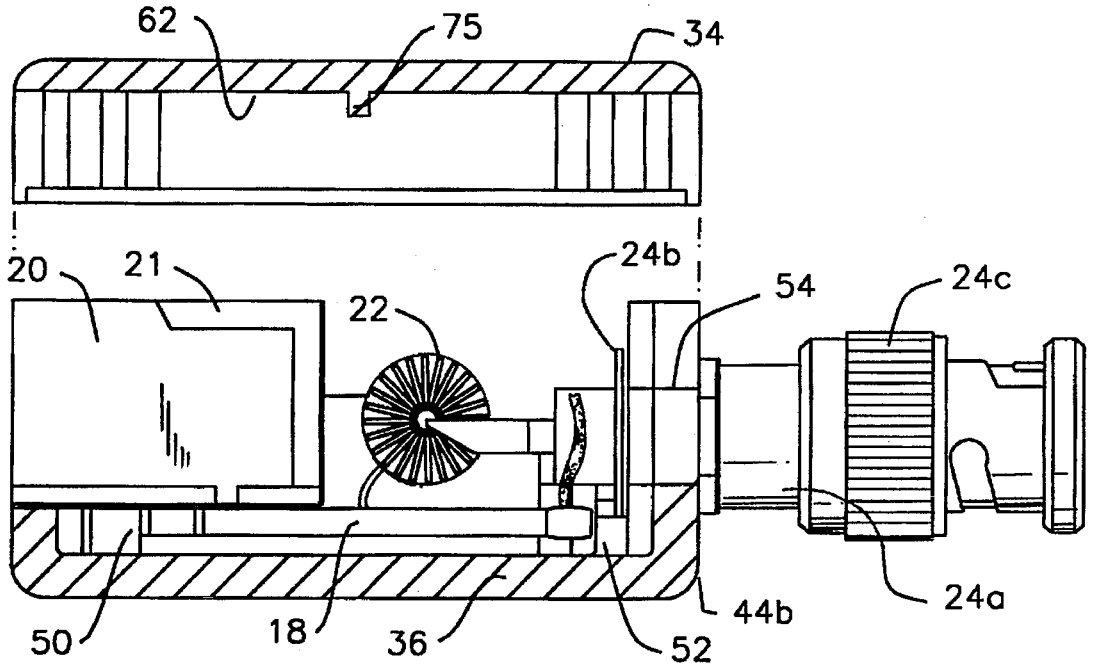
FIG. 6 is an exploded side view, partially in section, of the balun assembly of FIG. 1.
Figure 7:
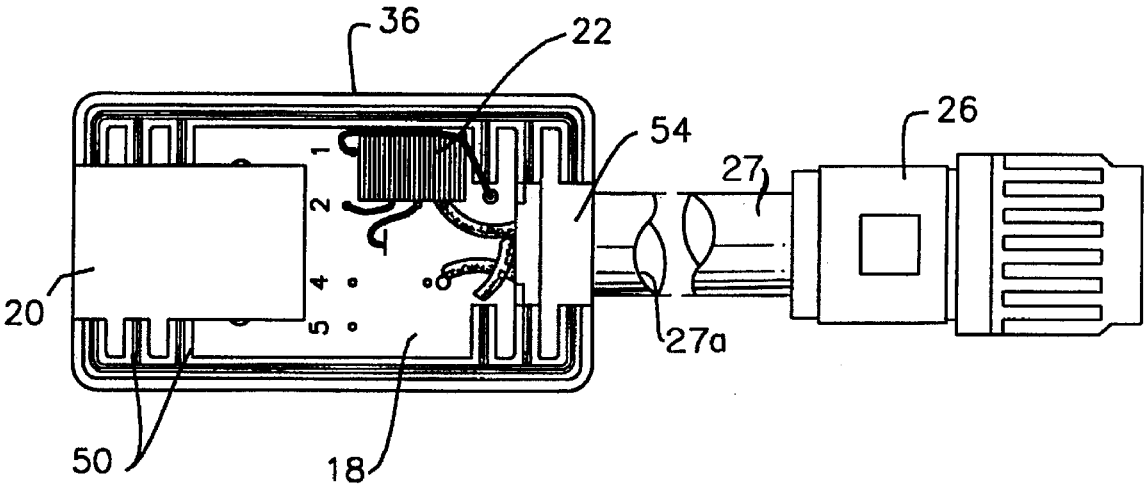
FIG. 7 is a top plan view of the lower balun housing of FIG. 2 supporting the electrical components therein.
Figure 8:
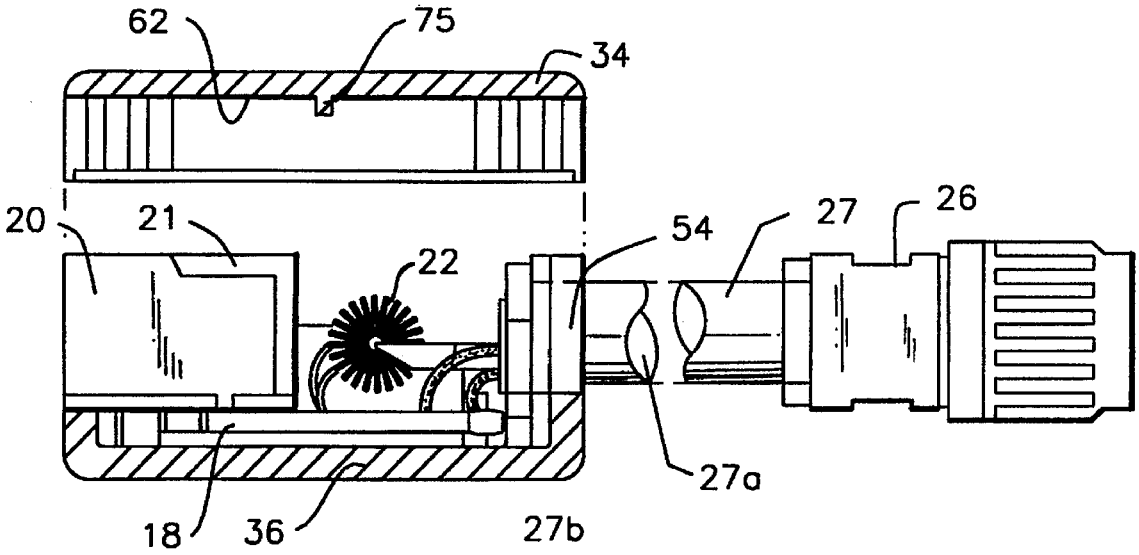
FIG. 8 is an exploded side view, partially in section, of the balun assembly of FIG. 2.

With additional references to FIGS. 5–8, balun components 14 may typically include an elongate printed circuit board (PCB) 18 having thereon a plurality of conductive traces. PCB 18 supports at one end a conventional shielded RJ45 jack connector 20 which permits connection of a mating RJ45 plug (not shown) terminating a length of STP cable. The RJ45 jack connector 20 is shielded in conventional fashion by placement of a metallic shield 21 therearound. Mounted in an intermediate location along PCB 18 is a toroid transformer 22 which effects the electrical impedance matching of the balun components 14. Opposite RJ45 jack connector 20, PCB 18 supports a further connection device. The present invention contemplates in two embodiments, support of either a coaxial connector 24 shown in FIGS. 1, 5 and 6 or a twinaxial connector 26 shown in FIGS. 2, 7 and 8. Coax connector 24 permits the connection of a terminated coaxial cable (not shown) while twinax connector 26 provides for the connection of a terminated twinaxial cable. As shown in FIGS. 2, 7 and 8, twinax connector 26 may include a length of shielded electrical cable 27 as may be required for a particular application.

PCB 18 electrically interconnects RJ45 jack connector 20, toroid transformer 22 and coax/twinax connector 24, 26 in conventional electrical fashion so as to establish the impedance matching characteristics therebetween. Printed traces on the underside of PCB 18 provide for such electrical connection. Such printed traces also provide for the electrical interconnection of the shield 21 of jack connector 20 with the shield of coax/twinax connector 24, 26. In this manner, electrical continuity is maintained between the shielded components of the balun components 14.

Referring specifically to FIGS. 1–4, housing 12 is an elongate rectangular member typically formed of molded insulative plastic. Housing 12 includes a first end 30 having a central aperture 30*a* therein which permits interconnection access to RJ45 jack connector 20. Housing 12 includes a second opposite end 32 including a central aperture 32*a* which accommodates coax/twinax connector 24, 26. Housing 12 includes two interfitting components, an upper housing portion 34 and a lower housing portion 36. As shown in FIG. 1, balun components 14 are supported between upper housing portion 34 and lower housing portion 36. The housing portions include respective perimetrical edges 34*a* and 36*a* which are designed to be interfitting so as to assemble upper housing portion 34 to lower housing portion 36 to form housing 12.

Figure 10:
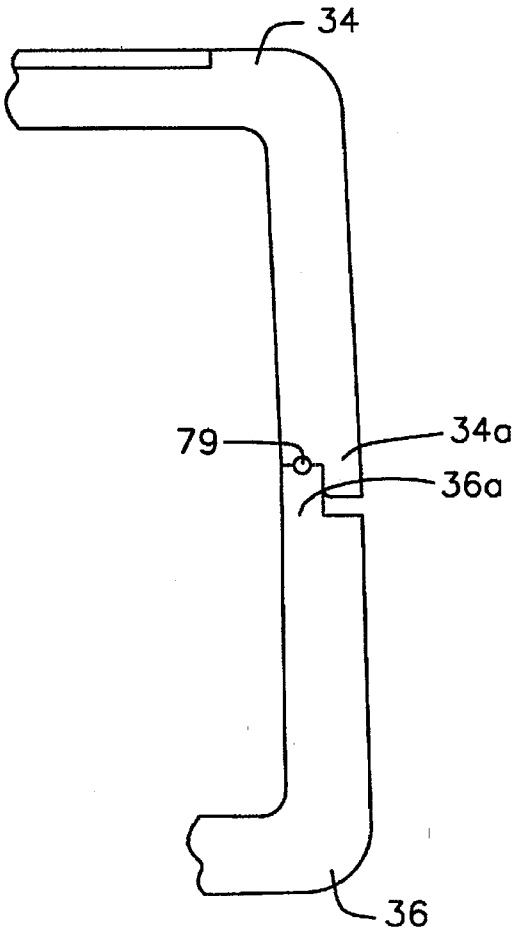
FIGS. 9 and 10 are schematic representations of the interconnection of the upper and lower housing portions of the balun of the present invention.
Figure 9:
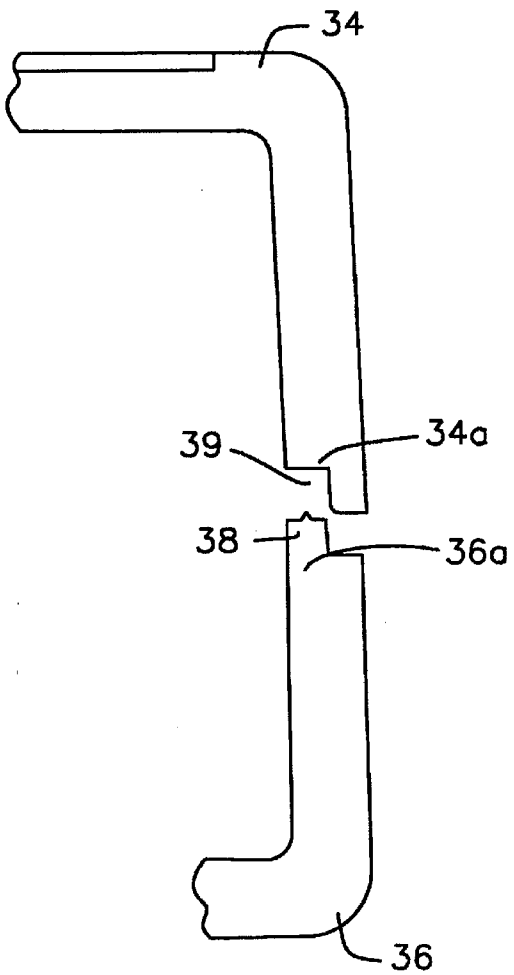

With reference to FIG. 9 and 10, edge 36*a* of lower housing portion 36 includes a upwardly extending perimetrical lip 38 which is insertable into a perimetrical recess 39 of edge 34*a* of upper housing portion 34. In a manner more fully described hereinbelow, the interface between lip 38 and recess 39 may be effectively fused to bond upper housing portion 34 to lower housing portion 36.

The housing 12 of the present invention is designed to provide full electrical shielding to the balun components 14 supported therein. In that regard, each of upper housing portion 34 and lower housing portion 36 is fully plated with a conductive metallic plating (such as shown at 37). The plating 37 of upper housing portion 34 and lower housing portion 36 is complete in that the entire surface area of the housing is plated both internally and externally. Also plated are edges 34*a* and 36*a*, including lip 38 and recess 39. Plating may be accomplished in a manner which is well known in the plating art. Preferably the plating includes a first plating layer of copper of about 40–60 microinches followed by a second plating of nickel of about 10–15 microinches. After the entire upper housing portion 34 and lower housing portion 36 are fully plated, the external surfaces thereof may be painted (such as shown at 41) for aesthetic purposes. When painting the housing portions for aesthetic purposes, none of the internal surfaces are painted as the plating thereon is to be maintained in conductive contact with the components supported within the balun as will be described in further detail hereinbelow.

Referring more specifically to FIGS. 1, 3, 4, 7 and 8, detailed construction of housing 12 may be described. Lower housing portion 36 forms a base which accommodates balun components 14 over which upper housing portion 34 may be attached as a cover. Lower housing portion 36 includes a planar surface 42 bounded by upwardly extending opposed endwalls 44*a* and 44*b* and opposed sidewalls 46*a* and 46*b*. Each endwall 44*a* and 44*b* includes upwardly opening notches 30*a'* and 32*a'* (FIGS. 3 and 4) partially defining apertures 30*a* and 32*a*. Adjacent endwall 44*a*, opposed sidewalls 46*a* and 46*b* include two pairs of longitudinally spaced inwardly directed vertically extending ribs 50. Ribs 50 are positioned adjacent endwall 44*a* and are dimensioned to frictionally accommodate therebetween the shielded RJ45 jack connector 20. Upon insertion of balun electronics 14 into the interior 48 of lower housing portion 36, ribs 50 frictionally engage the metallic shield 21 on the exterior surface of jack connector 20. As the entire lower housing portion 36 is conductively plated including ribs 50, conductive interconnection is maintained between shielded RJ45 jack connector 20 and lower housing portion 36. Each set of ribs 50 provides independent redundant frictional electrical engagement with the outer shield 21 of RJ45 jack connector 20. The ribs 50 of lower housing portion 36 are constructed so that upon insertion of balun electronics 14 thereinto, a force-fit relationship is established between the ribs and the jack connector so as to maintain conductive engagement therebetween. In order to further assure conductive engagement between RJ45 jack connector 20 and ribs 50, a frictional conductive strap 51 may be employed over the shield of the RJ45 jack connector 20. Such conductive strap may be formed of braided copper and is designed to be wedged between the shield 21 of the jack connector 20 and one set of ribs 50.

Lower housing portion 36 further includes a second set of longitudinally spaced vertically extending ribs 52 extending inwardly from sidewalls 46*a* and 46*b* adjacent endwall 44*b*. Ribs 52 are also provided to assist in the conductive engagement of the coax/twinax connector 24, 26 with lower housing portion 36 in a manner set forth hereinbelow.

In order to maintain such conductive engagement with coax/twinax connector 24, 26, the present invention provides a shielded collar 54 shown in more detail in FIGS. 1, 5 and 7. Shielded collar 54 is designed to frictionally accommodate coax/twinax connector 24, 26. Shielded collar 54 includes a central body 54*a* having an inverted U-shaped passage 54*b* which accommodates therein coax/twinax connector 24, 26. Shielded collar 54 includes a pair of lateral wings 54*c* for engagement with lower housing portion 36 as will be described in further detail hereinbelow. As with housing 12, collar 54 is fully plated with a metallic plating 37. Also to enhance its aesthetic appearance, the central body 54*a* of collar 54 may be painted.

Turning now to FIGS. 5 and 6, one embodiment of the present invention including coax connector 24 is shown. Coax connector 24 is a metallic connector having an outer generally cylindrical metal body portion 24*a* forming a shield. Collar 54 is slipped over cylindrical body portion 24*a* so that conductive engagement is made between plated collar 54 and coax connector 24. A locking washer 24*b* (FIG. 6) or other device may be used to mechanically secure coax connector 24 to collar 54. Thus, electrical continuity is maintained between the plated collar 54 and the metallic body of coax connector 24. Collar 54 is then slipped between the forward set of ribs 52 and endwall 44*b* of lower housing portion 36. Collar 54 is constructed so that frictional engagement is made between the plated unpainted wings 54*c* and the sidewalls 46*a* and 46*b* of lower housing portion 36. Thus, electrical continuity is established between the shielded coax connector 24 and lower housing portion 36 through collar 54.

Referring to FIGS. 7 and 8, similar conductive engagement is made between lower housing portion 36 and twinax connector 26. Cable portion 27 of connector 26 includes an outer jacket 27*a* and an internal metallic cable shield (not shown). An end portion of cable 27*b* adjacent lower housing portion 36 is stripped back exposing the shield. Collar 54 is positioned over cable portion 26*b* so that the collar is placed in conductive engagement with the metallic cable shield. The collar 54 is inserted into lower housing portion 36 in a manner described above, so as to make conductive engagement therewith. This establishes conductive continuity between twinax connector 26 and lower housing portion 36.

Figure 3:
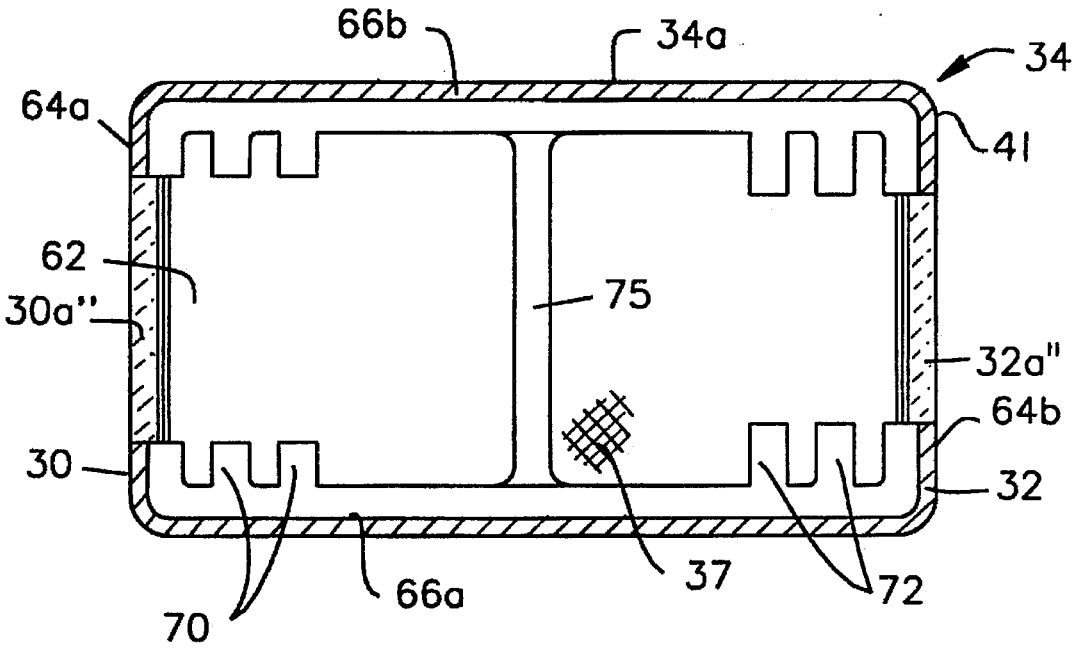
FIG. 3 is a bottom plan view of the upper housing portion of the balun of FIG. 1.
Figure 4:
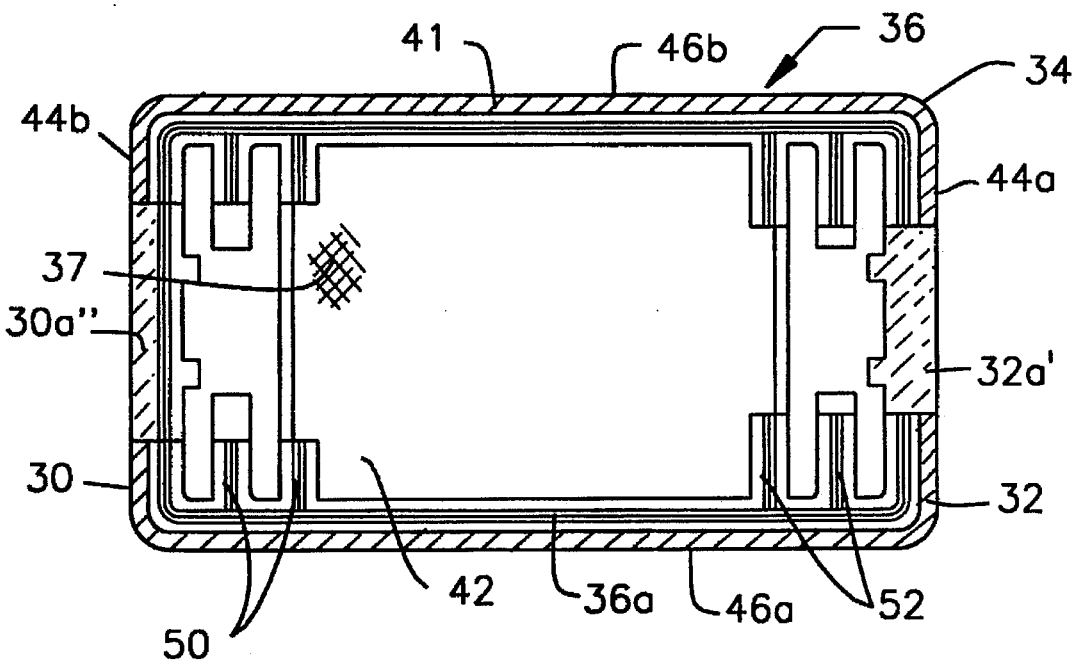
FIG. 4 is a top plan view of the lower housing portion of the balun of FIG. 1.

Once balun components 14 are supported within lower housing portion 36, upper housing portion 34 may be supported thereover. Referring additionally to FIG. 3, upper housing portion 34 includes a planar surface 62 and opposed endwalls 64*a*, 64*b* and opposed sidewalls 66*a* and 66*b*. Endwalls 64*a*, 64*b* include notches 30*a*", 32*a*" which partially define apertures 30*a* and 32*a*. Upper housing portion 34 is of construction similar to that of lower housing portion 36 and is fully metallically plated such as at 37. Upper housing portion 34 may also be painted in a similar manner for aesthetic purposes. Upper housing portion 34 includes inwardly directed ribs 70 adjacent endwalls 64*a* and inwardly directed ribs 72 adjacent endwall 64*b*. The ribs are of like construction to ribs 50 and 52 of lower housing 36 and similarly respectively conductively engage the shield of RJ45 jack connector 20 and collar 54. A central dividing wall 75 extends from surface 62 between sidewalls 66*a* and 66*b* to locate and positionally confine RJ45 jack connector 20. Thus, the balun components 14 are placed in direct conductive engagement with upper housing portion 34.

While each of upper housing 34 and lower housing 36 are in conductive engagement with both RJ45 jack connector 20 and coax/twinax connector 24 and 26 independently, upper housing portion 34 is bonded to lower housing portion 36 so as to establish direct conductive continuity between upper housing portion 34 and lower housing portion 36 so as to maintain shielded ground continuity continuously about balun components 14.

Referring again to FIGS. 9 and 10, the engagement between upper housing portion 34 and lower housing portion 36 is shown. While numerous bonding techniques may be used to secure the housing portions together, the present invention preferably contemplates, in one embodiment, the use of conventional ultrasonic welding equipment (not shown) well known in the art to weld the respective edges 34*a* and 34*b* of upper housing portion 34 and lower housing portion 36 together. The ultrasonic action fuses extending lip 38 of lower housing portion 36 within the recess 39 of upper housing portion 34. After such ultrasonic fusion, a weld such as shown at 79 includes a mass of plastic and metal material at the interface. However, surfaces adjacent the fused mass are sufficiently conductively plated so as to establish electrical continuity between the upper housing portion 34 and lower housing portion 36. The ultrasonic weld both mechanically and electrically bonds upper housing portion 34 to lower housing portion 36.

While ultrasonic welding is described as the preferred embodiment of the present invention, other techniques are also contemplated. As shown in FIG. 10, a bead such as shown at 79 of conductive adhesive may be employed between upper housing portion 34 and lower housing portion 36 so as to conductively and adhesively bond lip 38 within recess 39. Again both mechanical and electrical engagement is maintained between upper housing portion 34 and lower housing portion 36.

In accordance with the present invention, a fully shielded housing for balun electronics 14 is provided. The plated upper and lower housings 34 and 36 shield not only the RJ45 jack connector 20 at one end of housing 12 and coax/twinax connector 24, 26 at the other end of housing 12, but also shield the remaining balun components 14 supported therebetween. This is done without the need to provide a sheet metal casing within the balun housing which unnecessarily takes up space and could result in a reduction in freedom for designing the electrical circuit.

The present invention also establishes redundant conductive continuity between the RJ45 jack connector 20 and the coax/twinax connector 24, 26 by providing such conductive continuity through the circuit of the balun components 14 as well as through the shielded housing 12 of the balun.

Various changes to the foregoing described and shown structures would now be evident to those skilled in the art. Accordingly, the particularly disclosed scope of the invention is set forth in the following claims.

What is claimed is:

1. A shielded electrical connection assembly comprising:

a shielded housing including first and second housing members, each housing member being fully covered with a conductive plating;

a pair of electrical connection components supported within said housing, each connection component including conductive shielding in electrical engagement with said conductive plating of said housing;

each of said first and second housing members including plated engagement elements formed integrally therewith, said plated engagement elements being engagable with said conductive shielding of said pair of electrical connection components to fixedly position said connection components between said first and second housing members and establishing electrical continuity between said plating of said housing members and said shielding of said pair of connection components;

an electrical circuit supported within said housing, said electrical circuit electrically interconnecting said conductive shielding of each of said connection components; and means for conductively securing said first and second housing member for enclosing said pair of connection components and said electrical circuit therebetween and for maintaining conductive continuity between said housing members.

2. An assembly of claim 1 wherein said first and second housing members include opposed interengageable edges.

3. An assembly of claim 2 wherein said securing means includes joining said opposed edges of said first and second housing members.

4. An assembly of claim 3 wherein said securing means further includes an ultrasonic weld between said opposed edges of said first and second housing.

5. An assembly of claim 3 wherein said securing means further includes an adhesive bond between said opposed edges of said first and second housing.

6. An assembly of claim 5 wherein said adhesive bond is an electrically conductive adhesive bond.

7. An assembly of claim 3 wherein said conductive plating is a metallic plating.

8. An assembly of claim 3 wherein said opposed edges extend perimetrically around said respective first and second housing members.

9. An assembly of claim 8 wherein said edges are continuously joined.

10. An assembly of claim 8 wherein said first and second housing members define spaced apart apertures and wherein said pair of electrical connection components are supported adjacent said apertures.

11. An assembly of claim 1 wherein one of said electrical connection components is a shielded electrical connector.

12. An assembly of claim 1 wherein one of said electrical connection components is a shielded electrical cable.

13. A shielded housing for supporting an electrical balun assembly including a pair of spaced apart shielded connection components and an electrical circuit interconnecting said components, said housing comprising:

a conductively plated housing base, said base including plural integrally formed plated base elements for fixedly positioning said balun assembly, said plated base elements being electrically engagable with said shielded connection components; and a conductively plated housing cover supported over said base for enclosing said balun assembly therebetween, said cover including plural integrally formed plated cover elements for fixedly positioning said balun assembly, said plated cover elements being electrically engagable with said shielded connection components, said cover being securable to said base in a manner which establishes electrical continuity between said plating of said cover and said base within said balun assembly is fully shielded.

14. A shielded housing of claim 13 wherein said housing cover is securable to said housing base by an ultrasonic weld.

15. A shielded housing of claim 13 wherein said housing cover is securable to said housing base with conductive adhesive.

16. A shielded housing of claim 13 wherein said housing base and said housing cover define spaced apart apertures for accommodating said shielded connection components.

17. A shielded housing of claim 16 wherein said housing cover and said housing base are plated with metal.

* * * * *